US005864271A

United States Patent [19]

Mader

[11] Patent Number: 5,864,271

[45] Date of Patent: Jan. 26, 1999

[54] BISTABLE ELECTROMAGNET SYSTEM FOR A RELAY

[75] Inventor: Leopold Mader, Moedling, Austria

[73] Assignee: EH-Schrack Components-AG, Vienna, Austria

[21] Appl. No.: 947,363

[22] Filed: Oct. 8, 1997

[30] Foreign Application Priority Data

Oct. 8, 1996 [DE] Germany ..... 196 41 407.5

[51] Int. Cl.[6] ..... H01H 51/22

[52] U.S. Cl. ..... 335/78; 335/128; 335/80

[58] Field of Search ..... 335/78–80, 124, 335/128

[56] References Cited

U.S. PATENT DOCUMENTS 4,064,471 12/1977 Schuessler et al. ..... 335/229
4,933,654 6/1990 Hori et al. ..... 335/128
5,574,416 11/1996 Maruyama et al. ..... 335/78
5,703,550 12/1997 Pawlak et al. ..... 335/78

FOREIGN PATENT DOCUMENTS 0 686 989 A1 5/1995 European Pat. Off. .
295 02 797.5 2/1995 Germany .

*Primary Examiner*—Lincoln Donovan
*Attorney, Agent, or Firm*—Hill & Simpson

[57] ABSTRACT

A magnet system has a U-shaped core yoke whose yoke leg and core leg form a magnetic flux circuit together with an armature. A constriction section with reduced cross-section is provided at a location of the magnetic flux circuit, preferably at the core leg; a ferromagnetic bridge element with a flat permanent magnet is coupled to the magnetic flux circuit parallel thereto. Since the constriction section enters into saturation when the armature is attracted, the armature is held fast opposite a restoring spring. As a result of the inventive arrangement, a geometry for a magnetic circuit arrangement that is fast and inexpensive to manufacture is provided.

18 Claims, 2 Drawing Sheets

BISTABLE ELECTROMAGNET SYSTEM FOR A RELAY

BACKGROUND OF THE INVENTION

The present invention is directed to electric relays and, more specifically, to bistable electromagnetic systems for relays.

A bistable electromagnetic system for relays is disclosed, for example, by EP 0 686 989 A1. In the bistable switch mechanism therein, a part cross-section of the magnetic circuit is formed by the permanent magnet. This is realized such that the permanent magnet is inserted between the two parts of a two-part yoke and is correspondingly polarized in longitudinal yoke direction, whereby the rest of the cross-section is fashioned either as air gap or is filled to a greater or lesser extent by a ferromagnetic section. As a result of the two yoke parts joined to one another in longitudinal direction together with the additional permanent magnet, a tolerance summing derives for the length of the yoke, and additional fabrication outlay is required in order to bring one pole face at the end of the yoke into a common plane with a pole face at the end of the core. Said publication, however, also proposes an embodiment wherein a one-piece yoke with a lateral incision or slot is to be provided for the acceptance of the permanent magnet. In this case, the overall length of the yoke is not subject to any tolerance summing. However, the fitting of the permanent magnet into such an incision requires substantial outlay if a reproduceable coupling between the permanent magnet and the adjoining yoke parts is to be assured.

Accordingly, there is a need for an improved bistable electromagnetic system for relays which is easier and therefore less costly to manufacture.

SUMMARY OF THE INVENTION

The invention is directed to a bistable electromagnet system for a relay having

- a core yoke carrying a coil and having two pole ends,
- an armature that bridges the pole ends of the core yoke upon formation of at least one working air gap and forms a magnetic flux circuit therewith,
- a reset means that pre-stresses the armature in a quiescent position lifted off from the core yoke, and
- a constriction section of the magnetic flux circuit reduced in cross-section to which a permanent magnet is connected parallel.

An object of the present invention is to create a bistable electromagnetic system of the species initially cited wherein the permanent magnet is inserted such that the overall structure can be manufactured with optimally few parts in an optimally simple way. The geometry of the magnetic circuit should thereby be modified as little as possible due to the insertion of the permanent magnet compared to the geometry of a neutral magnet system with what is otherwise an identical structure.

In the system of the present invention, this object is inventively achieved in that a ferromagnetic bridge element is arranged parallel to a constriction section in the yoke leg, the bridge element has a first end section coupled large-area to the magnetic flux circuit and having its other, second end section forming a longitudinal gap to the magnetic flux circuit in which the permanent magnet polarized in the direction of the gap thickness is disposed. The constriction section is dimensioned such that it is saturated by the permanent magnet flux given a closed armature.

In the inventive magnet system, thus, the magnetic flux circuit is not interrupted by the insertion of the permanent magnet. The permanent magnet is thus not a geometrically defining part of the magnetic circuit. On the contrary, the magnetic circuit, preferably the yoke, is attenuated in cross-section in a portion adjacent to the permanent magnet, so that a part of the flux is conducted over the laterally coupled permanent magnet and the bridge element. The laterally coupled bridge element with the permanent magnet can be manufactured and mounted in an especially simple way, since its dimensions exercise no influence on the geometrical tuning between core yoke and armature and its tolerances therefore play no part. The attenuation at the constriction section of the magnetic flux circuit can likewise be accomplished without great additional outlay on the basis of a corresponding cut die or the like during manufacture of the core yoke or of the armature as well.

In a preferred embodiment, the core yoke, in a known way, comprises a U-shaped design with a core leg carrying the coil and a yoke leg whose free end faces aligned with one another in a plane, whereby an end section of the yoke leg carries the permanent magnet with the bridge element. The yoke leg can thereby accept the permanent magnet and the bridge section with correspondingly step-shaped offsets in the cross-section of its basic contour, so that the geometrical dimensions essentially exactly correspond to those of a neutral magnet system without a permanent magnet that is otherwise identically constructed.

Even though the constriction section and the permanent magnet with the bridge element are provided at a section of the core yoke and, preferably, in the end region of a yoke leg in the preferred embodiment, the invention could also be realized in that the armature comprised a constriction section and were provided with the permanent magnet as well as the bridge element. Although one will usually want to provide the movable armature with optimally little mass, so that the attachment in the permanent magnet to the armature is somewhat unbeneficial in this respect, applications are nonetheless conceivable wherein this fact can be accepted.

It is likewise already been pointed out that the bridge element—in the preferred embodiment—is applied as an auxiliary part parallel to the section of the magnetic flux circuit comprising the constriction section. Here, too, a modification would be conceivable in such a way that, for example, an end section of the yoke is provided with a longitudinal slot in order, as a result of the forked design of the yoke in one piece, to fashion the actual yoke section and the bridge element parallel thereto, whereby the permanent magnet would then be clamped between these fork ends. The main path of the yoke section would then have to be provided with a reduction in cross-section or, respectively, with a constriction, for example, with a bore perpendicular to the longitudinal extent of the yoke. In terms of fabrication, however, the embodiment with a separately manufactured and subsequently applied bridge element would probably be more beneficial. The bridge element can be secured to the magnetic circuit section, i.e. for example to the yoke leg, with one of the traditional methods, for example by gluing, point welding or laser welding.

In an embodiment, the present invention provides a bistable electromagnetic assembly for a relay that comprises a core yoke having a core leg and a yoke leg. A free end of the core leg is connected to an armature that extends between the free end of the core leg and the free end of the yoke leg. When the armature is in an open position, a working air gap is provided between the armature and the free end of the yoke leg. The armature is biased into the open position by a spring or other suitable biasing means.

The working air gap defines a magnetic flux circuit between the armature and the core yoke. The assembly further comprises a constriction section of the magnetic flux circuit. The constriction section may be disposed on the armature or the yoke leg and comprises a permanent magnet and a ferromagnetic bridge element. The bridge element includes an end portion which defines a second working air gap between the end portion and the magnetic flux circuit. The permanent magnet is disposed between the bridge element and the magnetic flux circuit and is polarized along this second working air gap. The constriction section is dimensioned such that the constriction section is saturated by the permanent magnet when the armature is in a closed position. Accordingly, the assembly of the present invention is in a stable condition when it is both open and closed.

In an embodiment, the free ends of the core leg and the yoke leg are aligned with one another in a common plane.

In an embodiment, the free end of the yoke leg has a wider and thinner cross section than the free end of the core leg.

In an embodiment, the yoke leg further comprises an end section disposed between the free end of the yoke leg and the constriction section of the yoke leg. The permanent magnet is sandwiched between the bridge element and the end section of the yoke leg.

In an embodiment, the constriction section is disposed on the yoke leg and the yoke leg further comprises an underside having a first recess for accommodating the permanent magnet and a second larger recess for accommodating the bridge element. The first recess is disposed within the boundaries of the second recess so that the permanent magnet is attached to the underside of the yoke leg at the first recess and the bridge element is attached to the underside of the yoke leg at the second recess with the permanent magnet sandwiched therebetween.

In an embodiment, the bridge element comprises a slot for accommodating the permanent magnet.

In an embodiment, the yoke leg comprises a slot for accommodating the permanent magnet and the bridge element.

In an embodiment, the constriction section is disposed on the armature and the permanent magnet and bridge element are attached to the end of the armature that engages the free end of the yoke leg when the assembly is in the closed position and which is spaced away from the free end of the yoke leg to create a working air gap when the assembly is in an open position.

It is therefore an advantage of the present invention to provide a bistable electromagnetic system for a relay that operates in a reliable manner and that is inexpensive to manufacture.

Other objects and advantages of the present invention will become apparent upon reading the following detailed description and appended claims, and upon reference to the accompanying drawings.

BRIEF DESCRIPTION OF THE DRAWING

The invention is explained in greater detail below with reference to the exemplary embodiments on the basis of a drawing. In the drawing.

Figure 1:
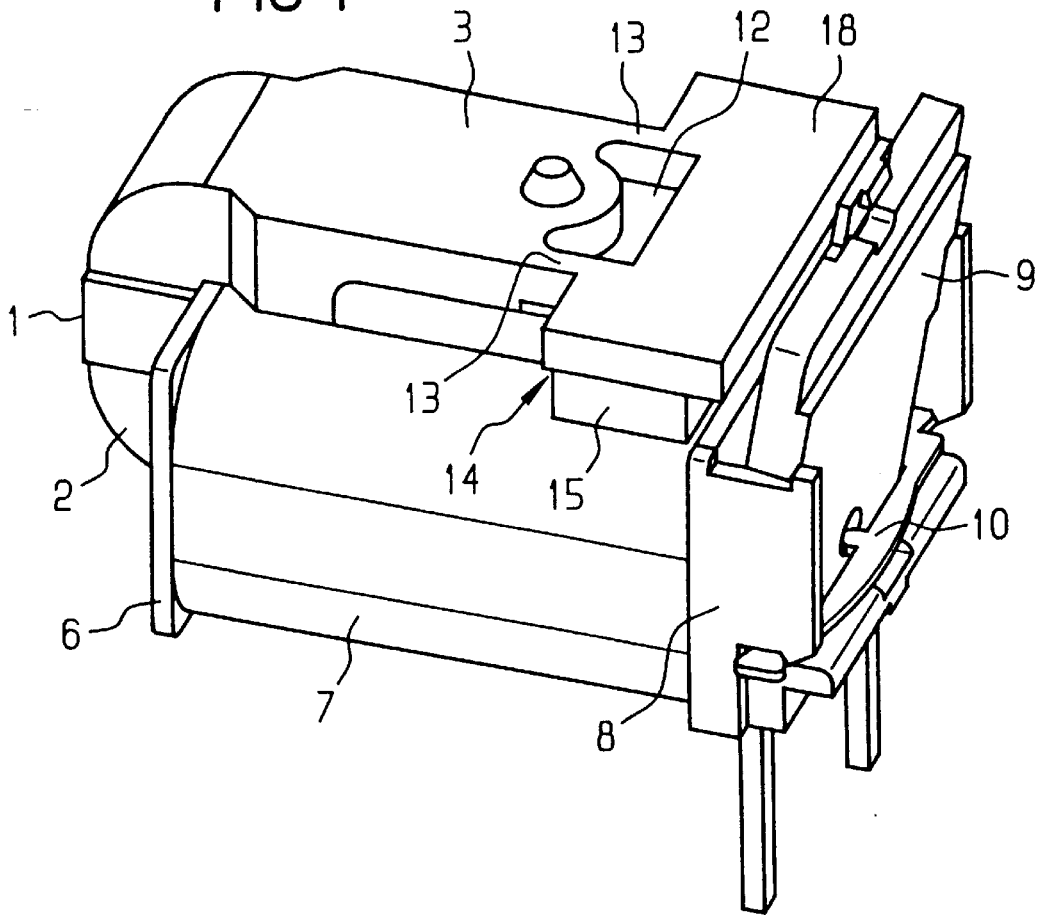
FIG. 1 is a perspective view of a magnetic relay system (shown without a contact arrangement) designed in accordance with the present invention.
Figure 2:
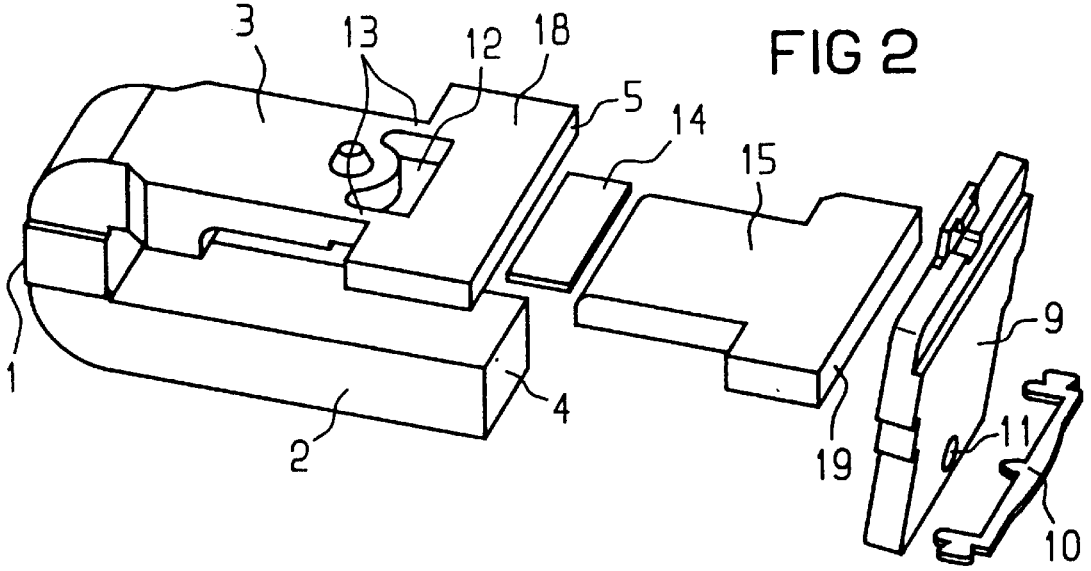
FIG. 2 is an exploded view of the iron circuit parts of the relay shown in FIG. 1.
Figure 3:
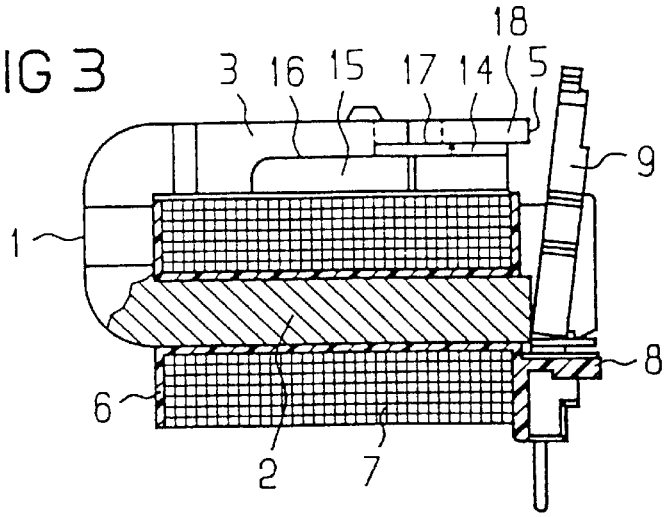
FIG. 3 is a side sectional view of the coil and core of the magnetic relay system of FIG. 1.
Figure 4:
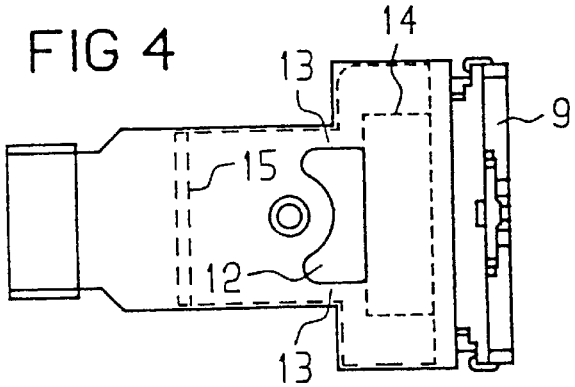
FIG. 4 is plan view of the coil and core of the magnetic relay system of FIG. 1.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The magnet system shown in FIGS. 1 through 4 has a U-shaped core yoke 1 with a core leg 2 and a yoke leg 3 whose end faces 4 and 5 are aligned with one another in a plane. The core leg 2 carries a coil member 6 having a winding 7. Further, a plate-shaped armature 9 is pivotably seated at the end face 4 of the core or, to be more precise, in a notch between the end face 4 and a continuation 8 of the coil member, a working air gap being provided between the armature 9 and the end face 5 of the yoke leg as pole surface. The armature is pre-stressed outward away from the yoke leg 5 in its quiescent position with a restoring spring 10 that is attached to the continuation 8 of the coil member at both sides and engages in a recess 11 at the outside of the armature.

Close to its free end, the yoke leg 3 is provided with a recess 12 and thus forms a constriction section 13 in the form of two narrow, lateral webs. This constriction section, of course, could also be fashioned in some other way. What is important is that the constriction section can absorb only a certain amount of magnetic flux before it is saturated and thus forces the additional magnetic flux onto a parallel circuit that is formed by a flat permanent magnet 14 and a ferromagnetic bridge element 15. For geometrical accommodation of these parallel circuit elements, the yoke leg 3 is provided with two graduations or recesses 16 and 17. The bridge element 15 is inserted such at the first graduation 16 that the overall thickness of the yoke leg at this location together with the bridge element corresponds to the basic thickness of the yoke leg 3. Due to the second graduation 17, a gap is formed between the bridge element 15 and the end section of the yoke leg 3. The permanent magnet 14 having a polarization directed transversely relative to the gap length and relative to the gap width is inserted into this gap. Thus, the permanent magnet 14 has one pole coupled to the end section of the yoke leg 3 and has its opposite pole coupled to the bridge element 15. For compensation of the thickness of the yoke leg 3 in the end region 18 diminished by the graduation 16 and 17, this end section 18 is made broader, so that it exhibits an adequate cross-section and an adequately large pole surface 5 for the excitation and the holding flux. Correspondingly, the bridge element 15 is also broadened in the region lying opposite the end section 18, so that the control flux can pass over a large air gap surface through the permanent magnet and, next to the permanent magnet, from the end section 18 to the bridge element 15. As shown, the permanent magnet is extremely flat and is polarized in the direction of its short axis or thickness (or vertical direction from the perspective shown in FIG. 3. For example, it can have a thickness on the order of magnitude of 0.3 mm.

The function of the described magnet system derives from the arrangement of the individual parts. In the illustrated, unexcited condition, the armature 9 is pre-stressed by the restoring spring 10 in the break condition. The flux of the permanent magnet 14 is closed via the end section 18 as well as the constriction section 13 of the yoke leg 3 and the bridge element 15, whereas the stray flux over the pole surface 5 and the working air gap to the armature is inadequate to attract the armature opposite the restoring force of the spring 10.

When an excitation that superimposes on the permanent magnetic flux in the working air gap in the same direction thereof is generated in the coil, then the armature is attracted. After the excitation is deactivated, the armature remains attracted since the constriction section 13 of the yoke leg proceeds into saturation and adequate permanent magnetic flux can thus flow via the armature in order to keep this attracted opposite the restoring force of the spring 10.

When, however, the coil is oppositely excited, whereby a part of the excitation flux proceeds via the magnet and weakens it due to the saturation in the constriction region 13, the excitation flux is super imposed on the permanent magnetic flux in the air gap in a direction opposite thereto and thus causes the armature to drop off, supported by the restoring spring 10. A relatively weak restoring spring 10 thereby already suffices in order to hold the armature in the break position. As a result of the single-piece fashion of the core yoke, the pole surface 5 and the end face 4 of the core can be calibrated in one plane in a simple way, since the additionally applied permanent magnet 14 with the bridge element 15 has no influence on the geometry between core yoke and armature. The end face 19 of the bridge element is at such a distance from the armature that it does not act as a pole surface. At the very most, the stray flux could be influenced by the spacing of this end face from the armature in order to achieve a fine tuning in the response behavior of the magnet system. Moreover, it is simplest for the manufacture to provide the core yoke with the graduations 16 and 17 by coining during the manufacture of the core yoke and to subsequently introduce the bridge element. The permanent magnet is thereby expediently applied onto the bridge element, for example glued, at this point and the bridge element is then secured to the yoke leg 3. In this case, too, a glued fastening is the preferred assembly type. However, a spot welding or a laser welding would also be possible. The magnet system can be inserted in a relay in a known way, whereby the contact springs (not shown) can be actuated by the free end of the armature via a slide.

Figure 5:
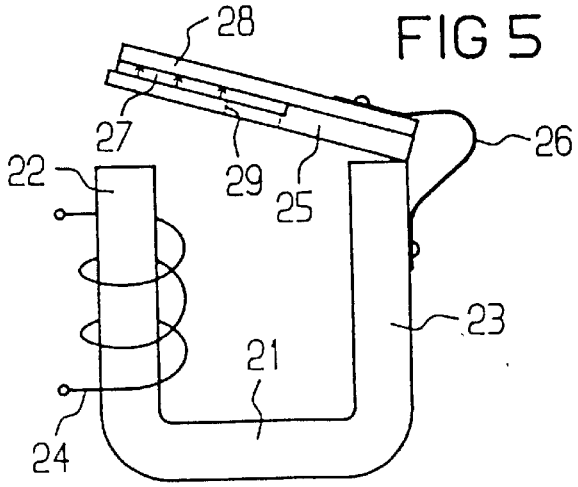
FIG. 5 is schematic illustration of a modified, second exemplary embodiment of the magnetic relay system of the present invention.

FIG. 5 schematically shows another possible embodiment. In this case, a U-shaped core yoke 21 with a core leg 22 and a yoke leg 23 is shown, whereby the core leg carries a coil winding 24. An armature 25 is seated at the face side of the yoke leg 23 and is held or, respectively, pre-stressed in its quiescent position via an armature spring 26. The armature forms the working air gap with the free end of the core leg 22. In this case, the armature has a constriction section or, respectively, a section 29 attenuated in cross-section that is not visible it the side view and that is therefore only indicated with broken lines. A permanent magnet 27 is provided with a polarization proceeding transversely relative to the longitudinal expanse is arranged on the free end of the armature. Preceding the constriction section 29, a ferromagnetic bridge element 28 couples the upper pole of the permanent magnet 27 parallel to the constriction section 29 at the seated end of the armature 25. The bridge element 28 is fashioned to a simple plate in this case, whereas the armature comprises a step offset with the thickness of the permanent magnet 27. However, it would also be conceivable to manufacture the armature 25 of one piece with the bridge element 28 and to provide it with a slot having the thickness of the permanent magnet 27 and to subsequently clamp the permanent magnet in this slot. In this case too, a recess for forming the constriction section 29 would have to be introduced into the lower part of the armature 25 that accepts the main flux.

From the above description, it is apparent that the objects and advantages of the present invention have been achieved. While only two embodiments have been set forth, alternative embodiments and various modifications will be apparent from the above description to those skilled in the art. These and other alternatives are considered equivalents and within the spirit and scope of the present invention.

What is claimed:

1. A bistable electromagnet assembly for a relay, the assembly comprising:

a core yoke comprising a core leg and a yoke leg, the core leg comprising a free end, the yoke leg comprising a free end, the core yoke extending through a coil, the free end of the core leg being connected to an armature that bridges the free end of the core leg and the yoke leg with a first working air gap between the armature and the free end of the yoke leg when the assembly is in an open position, the first working air gap for defining a magnetic flux circuit between the armature and the core yoke, the armature being biased into the open position and lifted off from the free end of yoke leg by a spring, and the assembly further comprising a constriction section of the magnetic flux circuit, the constriction section having a cross section, the constriction section being connected to an end section having a cross section that is larger than the cross section of the constriction section, the end section and the constriction section being connected to a ferromagnetic bridge element with a permanent magnet sandwiched between the end section and the ferromagnetic bridge element, the bridge element comprising an end which defines a second air gap between said end of the bridge element and the magnetic flux circuit, the permanent magnet being polarized between the end of the bridge element and the end section and perpendicular to the magnetic flux circuit, and the constriction section being dimensioned such that the constriction section is saturated by the permanent magnet when the armature is in a closed position and engaging the end of the yoke leg.

2. The assembly of claim 1 wherein the core yoke comprises a U-shaped structure with the free ends of the core leg and the yoke leg being aligned with one another in a plane.

3. The assembly of claim 1 wherein the constriction section is disposed on the yoke leg and the free end of the yoke leg has a cross section that is wider and thinner than a cross section of the free end of the core leg.

4. The assembly of claim 1 wherein the constriction section is disposed on the yoke leg and the yoke leg further comprises an end section disposed between the free end of the yoke leg and the constriction section, the permanent magnet being sandwiched between the bridge element and the end section of the yoke leg.

5. The assembly of claim 4 wherein the end section of the yoke leg has a cross section that is wider and thinner than a cross section of the free end of the core leg.

6. The assembly of claim 1 wherein the constriction section is disposed on the yoke leg and the yoke leg further comprises an underside comprising a first recess for accommodating the permanent magnet and a second recess for accommodating the bridge element, the first recess being disposed in the second recess and the permanent magnet being connected to the underside of the yoke leg at the first recess and the bridge element being attached to the underside of the yoke leg at the second recess with the permanent magnet sandwiched therebetween.

7. The assembly of claim 6 wherein a cross sectional area defined by the yoke leg, permanent magnet and bridge element is approximately equal in size to a cross sectional area defined by the free end of the core leg.

8. The assembly of claim 1 wherein the free end of the yoke leg is disposed closer to the armature when the assembly is in the open position than the second end of bridge element.

9. The assembly of claim 1 wherein the constriction section, the permanent magnet and the bridge element are provided on the armature.

10. The assembly of claim 1 wherein the bridge element comprises a slot for accommodating the permanent magnet.

11. The assembly of claim 1 wherein the constriction section is disposed on the yoke leg and the yoke leg comprises a slot for accommodating the permanent magnet and the bridge element.

12. A bistable electromagnet assembly for a relay, the assembly comprising:

a core yoke comprising a core leg and a yoke leg, the core leg comprising a free end, the yoke leg comprising a free end, the core yoke extending through a coil, the free end of the core leg being connected to an armature that extends between the free end of the core leg and the free end of yoke leg, the armature being biased into an open position and lifted off from the free end of yoke leg by a spring to provide a first working air gap between the armature and the free end of the yoke leg for defining a magnetic flux circuit between the armature and the free end of the yoke leg, and the yoke leg further comprising a constriction section comprising a reduced cross-sectional area, the constriction section being disposed adjacent to an end section, the end section being disposed between the constriction section and the free end of the yoke leg, the end section being connected to a ferromagnetic bridge element with a permanent magnet sandwiched between the ferromagnetic bridge element and the end section of the yoke leg, the end section of the yoke leg having a cross-sectional area that is larger than the reduced cross-sectional area of the constriction section, the bridge element comprising a first end connected to the yoke leg and a second end defining a second air gap relative to the magnetic flux circuit formed between the end of the yoke leg and the armature, the permanent magnet being polarized between the second end of the bridge element and the magnetic flux circuit, and the constriction section being dimensioned such that the constriction section is saturated by the permanent magnet when the armature is in a closed position and engaging the free end of the yoke leg.

13. The assembly of claim 12 wherein the core yoke comprises a U-shaped structure with the free ends of the core leg and the yoke leg being aligned with one another in a plane.

14. The assembly of claim 12 wherein the yoke leg further comprises an underside comprising a first recess for accommodating the permanent magnet and a second recess for accommodating the bridge element, the first recess being disposed in the second recess and the permanent magnet being connected to the underside of the yoke leg at the first recess and the bridge element being attached to the underside of the yoke leg at the second recess with the permanent magnet sandwiched therebetween.

15. The assembly of claim 14 wherein a cross sectional area defined by the yoke leg, permanent magnet and bridge element is approximately equal in size to a cross sectional area defined by the free end of the core leg.

16. The assembly of claim 12 wherein the free end of the yoke leg is disposed closer to the armature when the assembly is in the open position than the second end of bridge element.

17. A bistable electromagnet assembly for a relay, the assembly comprising:

a core yoke comprising a core leg and a yoke leg, the core leg comprising a free end, the yoke leg comprising a free end, the core yoke extending through a coil, the free end of the core leg engaging a first end of an armature that bridges the free end of the core leg and the free end of the yoke leg, the first end of the armature having a cross section, the armature being biased into an open position whereby the second end of the armature is lifted off from the free end of yoke leg by a spring, when the armature is the open position and the second end of the armature is lifted off the free end of the yoke leg, the second end of the armature and the free end of the yoke leg define a first working air gap for providing a magnetic flux circuit between the second end of the armature and the free end of the yoke leg, the armature further comprising a constriction section disposed at the second end thereof, the constriction section comprising a reduced cross-section in comparison to the cross section of the first end of the armature and the constriction section being connected to a permanent magnet, the permanent magnet further being connected to a ferromagnetic bridge element and sandwiched between the ferromagnetic bridge element and the constriction section of the armature, the bridge element comprising a first end connected to the armature and a second end defining a second air gap relative to the magnetic flux circuit formed between the free end of the yoke leg and the second end of the armature, the permanent magnet being polarized between the second end of the bridge element and the armature, and the constriction section being dimensioned such that the constriction section is saturated by the permanent magnet when the armature is in a closed position and the second end of the armature is engaging the free end of the yoke leg.

18. The assembly of claim 17 wherein the core yoke comprises a U-shaped structure with the free ends of the core leg and the yoke leg being aligned with one another in a plane.

* * * * *